US005572918A

United States Patent [19]

Grundke et al.

[11] Patent Number: 5,572,918

[45] Date of Patent: Nov. 12, 1996

[54] MULTI-FUNCTIONAL VALVE

[75] Inventors: Manfred Grundke, Dichtelbach; Roland Pfaff, Hafenlohr, both of Germany

[73] Assignee: Mannesmann Aktiengesellschaft, Düsseldorf, Germany

[21] Appl. No.: 428,876

[22] Filed: Apr. 25, 1995

[30] Foreign Application Priority Data

Apr. 25, 1994 [DE] Germany ..... 44 14 779.1

[51] Int. Cl.[6] ..... F15B 15/17; F15B 11/08

[52] U.S. Cl. ..... 91/417 R; 91/446; 91/448; 91/392

[58] Field of Search ..... 91/415, 417 R, 91/496, 499, 498, 358 R, 392

[56] References Cited

U.S. PATENT DOCUMENTS

| | | | |
|---|---|---|---|
| 2,966,139 | 12/1960 | Appel | 91/415 X |
| 3,053,234 | 9/1962 | Chevreux | 91/415 X |
| 4,700,612 | 10/1987 | Pfister | 91/415 X |
| 4,768,420 | 9/1988 | Korthaus | 91/417 R X |
| 4,958,548 | 9/1990 | Schulze | 91/415 X |

FOREIGN PATENT DOCUMENTS

| | | | |
|---|---|---|---|
| 4244304 | 6/1994 | Germany . | |
| 0017002 | 1/1984 | Japan | 91/415 |
| 103618 | 1/1963 | Netherlands | 91/417 R |
| 0646102 | 2/1979 | U.S.S.R. | 91/417 R |
| 1170239 | 11/1969 | United Kingdom | 91/417 R |

*Primary Examiner*—Hoang Nguyen
*Attorney, Agent, or Firm*—Cohen, Pontani, Lieberman, Pavane

[57] ABSTRACT

A hydraulic system having a high-pressure differential cylinder implemented as a servo actuator is hydraulically connected to a valve combination and an electro-hydraulic servo valve. The valve combination is a multi-functional valve including multiple interengaging valves and correcting elements all disposed within a housing. The valves and correcting elements are positioned and engaged along a functional axis of the multi-functional valve. This combination of valves provides for a single lightweight housing for the valve. The multi-functional valve is hydraulically connected via conduits with the servo valve and the differential cylinder. This device allows for the use of a single valve arrangement for controlling the numerous operating modes of the differential cylinder or servo actuator.

8 Claims, 6 Drawing Sheets

$P_S > 150$

Rs < 150

$P_S < 150$

MULTI-FUNCTIONAL VALVE

BACKGROUND OF THE INVENTION

1. Field of the Invention

The present invention relates to hydraulic systems used for operating elements on an aircraft and, more particularly, to hydraulic systems including a high-pressure differential cylinder and a valve combination hydraulically connected thereto.

2. Description of Prior Art

In the construction of an aircraft, especially in an aircraft having multiple jets, many servo actuators are needed. Each servo actuator is needed for operating particular aircraft systems such as wing components, spoilers, landing gear doors and many other systems of the aircraft. Each actuator is a small hydraulic system using a high pressure cylinder. A valve combination using an electro-hydraulic servo valve (EHSV) is needed to allow operation of these cylinders in different manners in accordance with different guidelines and conditions. The valve combination is normally connected to additional individual valves which allow for performance of other operating states in addition to the normal operating state.

For example, when operating a spoiler, which functions as a lift destroyer, a speed brake and a roll controller, an actuator which is able to operate in numerous modes is needed. These modes include a normal operating mode, a blocking mode at reduced system pressure, a thermal relief mode, a maintenance mode, and a mode for operating after detection of an hydraulic supply malfunction or electrical control signal error. For operating in all of these modes a combination of multiple individual valves is required. These individual valves are linked to the electro-hydraulic servo valve and are controlled for operating in each of the aforementioned modes.

The actuator and valve combinations needed for proper operation of an aircraft are large in size and high in weight due to the many individual valves needed for proper operation of the device. Because many of these devices are needed for controlling the various systems of an aircraft, the excess size and weight of each device is multiplied when all the devices are taken as a whole.

It is, thus, desirable to provide an hydraulic system in which the multiple individual valves are combined into a compact, lightweight, multi-functional valve. It would also be desirable to provide a housing in which the valve is arranged and wherein the correcting elements lie along a functional axis within the housing thereby reducing the size and improving the functionality of the device.

SUMMARY OF THE INVENTION

The object of the present invention is to provide an hydraulic system having a high-pressure differential cylinder allowing for various states of operation of a system.

It is a further object of the present invention to provide an hydraulic system which is small in size and light in weight.

A still further object of the present invention is to provide an hydraulic system which combines multiple individual valves into a compact multi-functional valve for use with a high-pressure cylinder.

An even further object of the present invention is to provide a multi-functional valve which is arranged in a valve housing such that correcting elements of the valve are disposed along a functional axis in the housing.

The present invention includes a differential piston which is acted on by a spring. In an unpressurized mode the piston is at rest against a mechanical stop. When a pressure is supplied to a chamber housing, the piston engages a tappet within a piston chamber. A disc seat valve is positioned in an overflow chamber on a side of the tappet opposite the piston. The tappet is caused to actuate the disc seat valve when engaged by the piston. When the disc seat valve is in its open position, the piston chamber and overflow chamber are connected through borings in the disc seat valve. The piston, tappet and valve combination are disposed along a functional axis in the housing and are connected to a differential cylinder and an electro-hydraulic servo valve (EHSV) through a series of conduits. The path through which the multi-functional valve and the differential cylinder are connected is controlled by the EHSV. Based upon the pressure supplied through a supply pressure port and the setting of the EHSV, a piston within the differential cylinder is caused to retract or extend. The retraction or extension of the piston is based on the mode of operation of the device and the setting of the EHSV. Other modes of operation in which pressure forces other than the supply pressure act on the system are also controllable by the multi-functional valve combination of the present invention, as will be explained hereinafter. Through the retracting or extending of the piston within the differential cylinder, the particular system to which the hydraulic control system is connected is caused to operate.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PREFERRED EMBODIMENT

Figure 1:
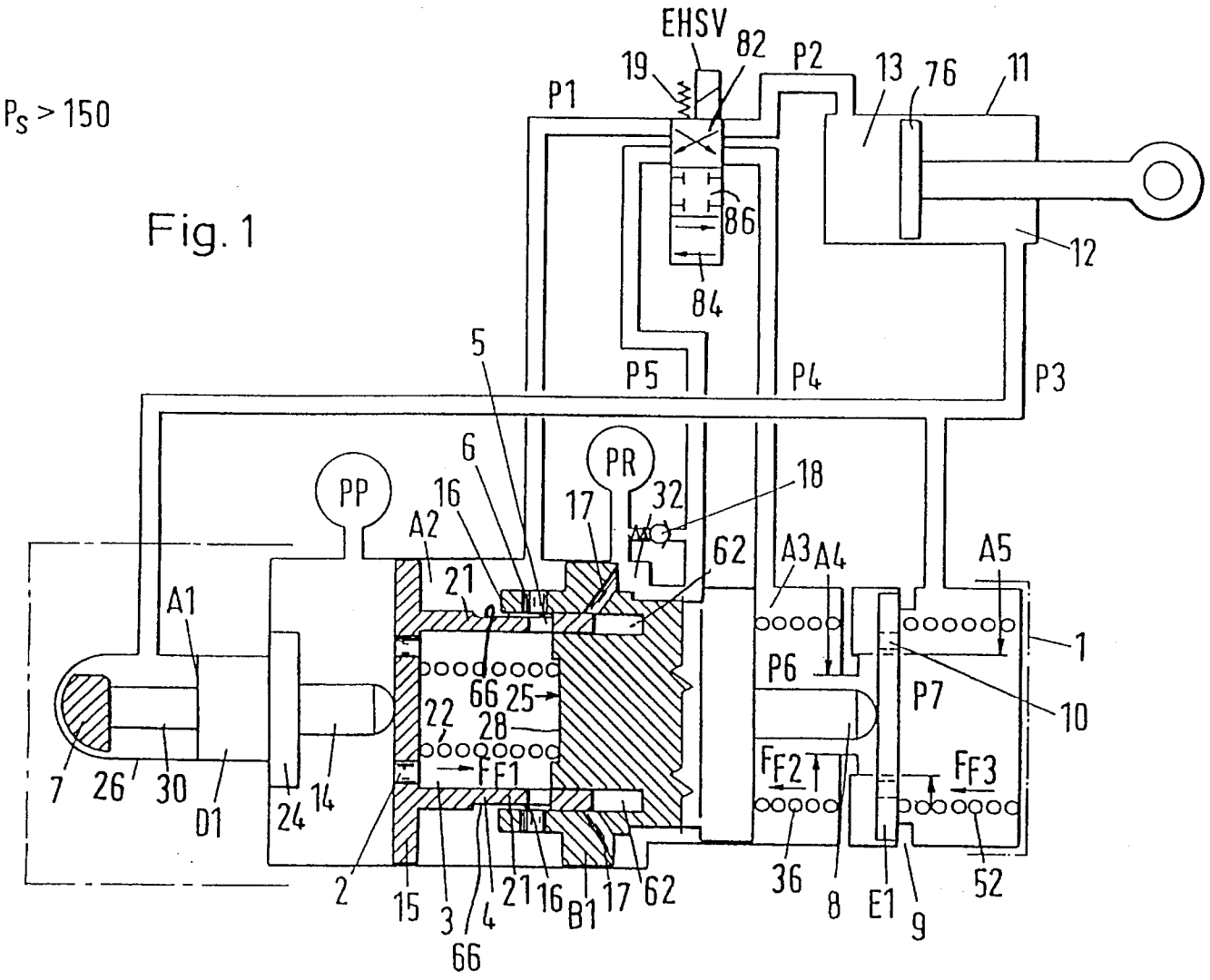
FIG. 1 is a semi-schematic side view, partly in cross section, of a multi-functional valve constructed in accordance with the present invention, shown in its normal mode and operating at a supply pressure of greater than 150 bar.

The present invention, as shown in FIGS. 1–6, is directed to a multi-functional valve 1 for combination with a high-pressure differential cylinder 11 and an electro-hydraulic servo valve (EHSV) in an hydraulic system, each Figure depicting operation of the system in a different mode.

The multi-functional valve 1, which will now be described with particular reference to FIG. 1, includes a differential piston B1 and a damping and control element 15. The differential piston B1 includes a circular recess 62. The bushing is formed as a bushing 4 having control a cylindrical sidewall or leg 21 and a cover piece. The bushing leg 21 is movably positioned within the recess 62. The differential piston B1 and the bushing 4 are coupled in this manner to form a chamber 3 which is bonded by a face 25 of the piston B1, the bushing leg 21 and the control element 15.

The bushing 4 and the differential piston B1 each include a radial boring 5 and 6, respectively. When the bushing 4 is aligned within the recess 62 of the piston B1 and a pressure within a certain defined range acts on the piston B1, the borings 5, 6 in the bushing leg 21 and piston B1 may be aligned. When the borings 5 and 6 are so aligned, they act to connect the chamber 3 with a pressure effective area A2.

Extending from the recess 62 and through the differential piston B1 is a slanted boring 17. The bushing leg 21 also includes an overflow channel 66 extending therealong, from the boring 5 and along the length of the chamber 3. The overflow channel 66 is positioned on an outer face or side of the bushing leg 21, opposite the chamber 3. The overflow channel 66 couples the slanted boring 17 with the pressure effective area A2 outside of the chamber 3 when the slanted boring 17 is in communication with the boring 5 and overflow channel 66 in the boring leg 21.

Located within the chamber 3 and positioned within a ring shaped recess 28 defined in the face side 25 of the differential piston is a spring 22 providing an elastic force in the direction of the arrow labelled $F_{F1}$. The effect of the spring 22 will be explained hereinafter.

On a side of the control element 15 opposite the chamber 3 is a supply pressure port PP for supplying hydraulic fluid to the valve 1. The control element 15 includes axially-positioned borings 2 which connect the supply pressure port PP with the chamber 3; the hydraulic fluid supplied by the supply pressure port PP is thus able to enter the chamber 3 through the borings 2.

Contacting the control element 15 on the side opposite the chamber is a tappet 14. Connected to the tappet 14 on a side of the tappet opposite the control element 15 is a stop comprised of a pressure limitation piston D1 and a rotatable cam 7. Positioned between the tappet 14 and the pressure limitation piston D1 is a ring shaped slot 24. The cam 7 is rotatably movable by an external lever mechanism 23 (see FIG. 5) and is used in a maintenance mode to manually bring the valve 1 into a certain position. The operation of the cam 7 during the maintenance mode will also be discussed hereinafter with particular reference to FIG. 5. Positioned between the cam 7 and the pressure limitation piston D1 is a piston rod 30. The pressure limitation piston D1, the piston rod and the cam 7 are all located in a cylinder housing 26. A pressure effective area on one side of the pressure limitation piston D1 is denoted as A1.

In contact with the differential piston B1, on a side opposite the chamber 3, is a second tappet 8 located in a pressure effective area A3. A spring 36 disposed within the pressure effective area A3 exerts an elastic force on the differential piston B1 in the direction of the arrow $F_{F2}$. The pressure effective area A3 is defined within a right pressure chamber P6 of the multi-functional valve 1. The tappet 8 extends outwardly from the pressure effective area A3 through an adjoining pressure effective area A4 to contact the movable disc member of a disc seat valve E1. The pressure effective area A4 is defined by a passageway extending through a wall in the pressure effective area A3, a passageway through which the second tappet 8 extends, for contact with the disc seat valve E1.

The disc seat valve E1 is disposed in a pressure effective area A5 defined within an overflow chamber P7 of the multi-functional valve 1. The disc seat valve E1 includes axial borings 10 therethrough for connecting the right pressure chamber P6 to the overflow chamber P7, and is movable between a closed position against a wall of the pressure effective area A3 and the FIG. 1 open position abutting a radially inward protrusion or seat 9 in the pressure effective area A5. The axial borings 10 connect the right pressure chamber P6 and the overflow chamber P7 when the disc seat valve E1 is in the open position, as shown in FIG. 1. When the disc seat valve E1 is in its closed position, the borings 10 are effectively blocked or closed by the wall of the pressure effective area A3 and the right pressure chamber P6 thereby sealed off from the overflow chamber P7, as seen in FIG. 2.

A spring 52, disposed in the overflow chamber P7, exerts an elastic force in the direction of the arrow $F_{F3}$ on the disc seat valve E1.

Also connected to the multi-function valve 1 is a feedback port PR. The feedback port PR is in communication with the pressure effective area A2 through the slanted boring 17 when the bushing 4 is positioned such that the overflow channel 66 communicates with the slanted boring 17. Also connected to the feedback port PR is a check valve 18. The feedback port PR is in constant communication with an intermediate area 32 defined between the feedback port PR and the differential piston B1.

The elements described above are all positioned within a valve housing and comprise the multifunctional valve 1 of the present invention. These elements are aligned within the housing and are disposed along a functional axis thereof.

The multi-function valve 1 is connected to the differential cylinder 11 and EHSV through a series of conduits.

The differential cylinder 11 includes a piston 76 which divides the cylinder 11 into an extension chamber 13 and a retraction chamber 12.

The EHSV determines the flow of hydraulic fluid through the conduits, and can be in a retraction mode 82, an extension mode 84 or a rest mode 86; the particular mode in which the EHSV is operating controls the extension or retraction of the piston 76 within the cylinder 11. The EHSV operating mode also acts to control the flow path of hydraulic fluid through the multi-function valve 1 and to the differential cylinder 11, and the EHSV may block the flow of hydraulic fluid when in the rest or bias position 86. The EHSV also includes a spring 19 which acts to set the mode of operation of the EHSV and thus the flow path of hydraulic fluid.

The pressure-effective area A2 is connected to the EHSV through a first conduit P1. A second conduit P2 connects the EHSV with the extension chamber 13. When the EHSV is in its extension mode, the pressure effective area A2 is connected to the extension chamber 13 through the first and second conduits P1, P2.

The overflow chamber P7 is connected to the retraction chamber 12 through a third conduit P3. The third conduit P3 also connects the retraction chamber 12 with the cylinder 26 housing the cam 7 and the pressure limitation piston D1. The right pressure chamber P6 is connected to the EHSV through a fourth conduit P4 and the feedback port PR is connected to the EHSV through the control valve 18 and a fifth conduit P5. The fourth and fifth conduits P4, P5 are connected by a bypass conduit (not shown).

When the EHSV is in the extension mode the feedback port PR is connected to the retraction chamber 12 through the fifth conduit P5 and the fourth conduit P4 via the EHSV, the right pressure chamber P6, the overflow chamber P7 and the third conduit P3.

When the EHSV is in the retraction mode, the feedback port PR is connected to the extension chamber 13 through the fifth conduit P5 and the second conduit P2. The pressure-effective area A2 is also connected to the retraction chamber 12 through the first conduit P1, the fourth conduit P4 via the EHSV, the right pressure chamber P6, the overflow chamber P7 and through the third conduit P3 in this mode.

The operation of the multi-function valve 1 will now be described with reference to the various operating modes depicted in FIGS. 1 to 6.

Figure 2:
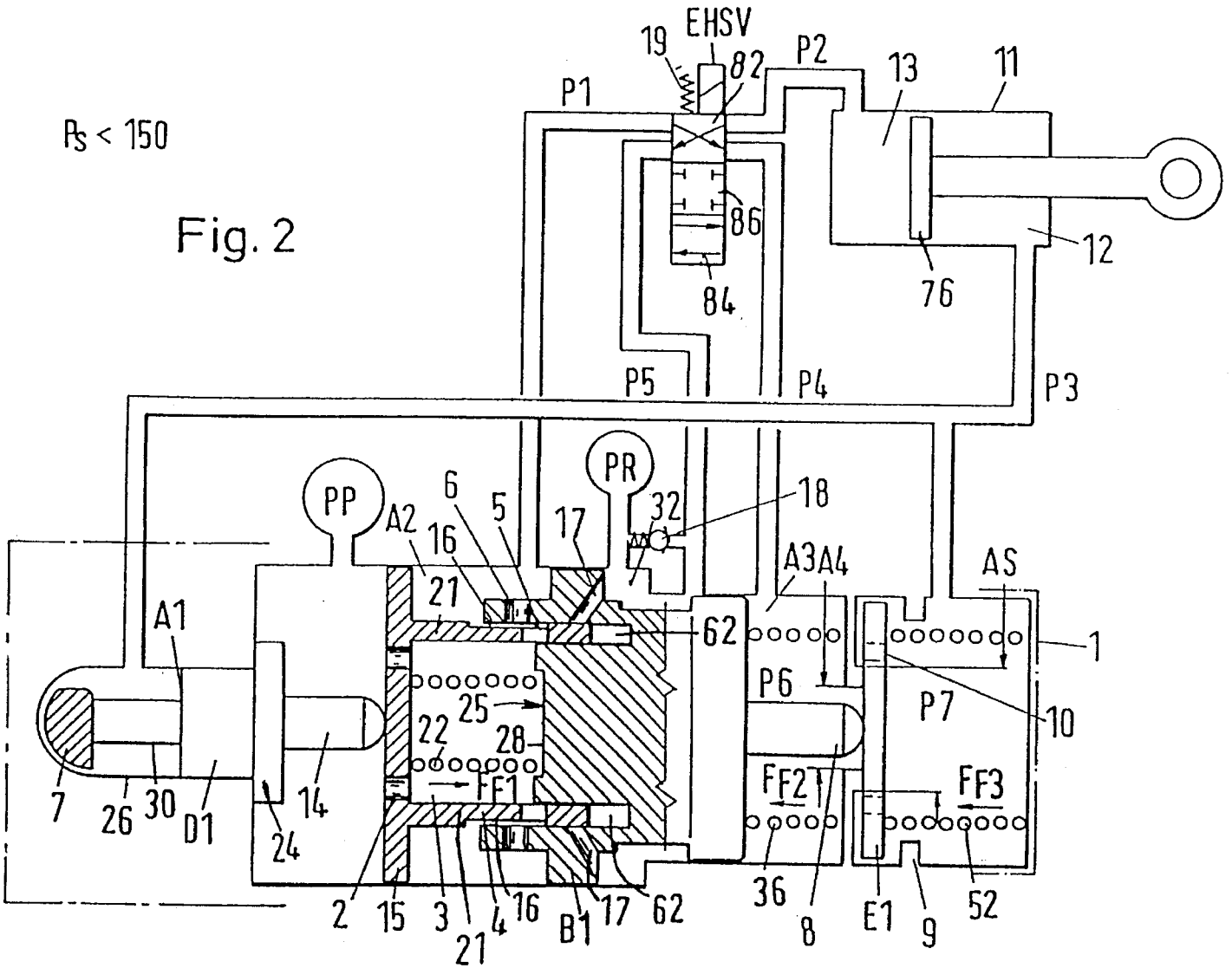
FIG. 2 is a semi-schematic side view of the multi-functional valve of FIG. 1 operating at a supply pressure of less than 150 bar.

FIG. 1 illustrates the normal operating mode of the multi-functional valve 1 at a supply pressure of above approximately 150 bar. In this mode, hydraulic fluid is caused to flow from the supply pressure port PP, through the axial borings 2 in the control element 15 and into the chamber 3. The pressure of the fluid builds up in the chamber 3 and acts on the differential piston B1, exerting a force in the direction of arrow $F_{F1}$ and also separating the differential piston B1 and the control element 15 as fluid fills the chamber 3. This causes the piston B1 to move to the right as shown in FIG. 1. This movement of the differential piston B1 causes the piston to block a bypass conduit (not shown) connecting the fourth and fifth conduits. When in the chamber 3, the hydraulic fluid forces the piston B1 to the right, as depicted in FIG. 1, until the borings 5, 6 are aligned. At this time the hydraulic fluid flows through the borings 5, 6 and into the pressure effective area A2, thus establishing a flow connection between the supply pressure port PP and the first conduit P1. The differential piston B1 continues to move in the direction of the arrow $F_{F1}$ and act on the second tappet 8 which, in turn, exerts a force on the disc seat valve E1, causing the disc seat valve E1 to move into its open position against the radially inward protrusion 9. The force exerted by the piston B1 is sufficiently great as to overcome the force of the springs 36 and 52 acting on the piston B1 and the disc seat valve El, respectively. The right pressure chamber P6 is thereby connected to the overflow chamber P7 through the borings 10 in the disc seat valve E1. By virtue of the fact that the pressure is greater than approximately 150 bar, the disc seat valve E1 remains in its open position at all times during this operating mode.

The EHSV is in its retraction mode which is shown in FIG. 1. In this mode, the supply pressure port PP is connected to the retraction chamber 12 through a series of conduits and chambers. This connection is established through the first conduit P1 to the EHSV, through the fourth conduit P4 to the right pressure chamber P6, through the borings 10 to the overflow chamber P7 and through the third conduit P3 to the retraction chamber 12. The connection between the supply pressure chamber PP and the first conduit P1, is as previously described, through the connection between the chamber 3 and the pressure effective area A2.

In the extension mode, the supply pressure port PP is connected to the extension chamber 13 through the first and second conduits P1, P2 via the EHSV. The feedback port PR is connected to the retraction chamber 12 through the fifth conduit P5 and via the EHSV to the fourth conduit P4, through the fourth conduit P4 to the right pressure chamber P6, through the borings 10 to the overflow chamber P7 and through the third conduit P3 to the retraction chamber 12.

In the retraction mode, the feedback port PR is connected to the extension chamber 13 through the second and fifth conduits P2, P5 via the EHSV.

Thus, based on the pressure supplied by the supply pressure port PP and the operating mode of the EHSV, the fluid is caused to flow through the multi-function valve 1 to act on the differential cylinder through the series of conduits P1–P5. This causes either a retraction or extension of the piston 76 within the cylinder 11 and thus controls the high pressure cylinder which acts in the manner of a servo actuator.

Figure 3:
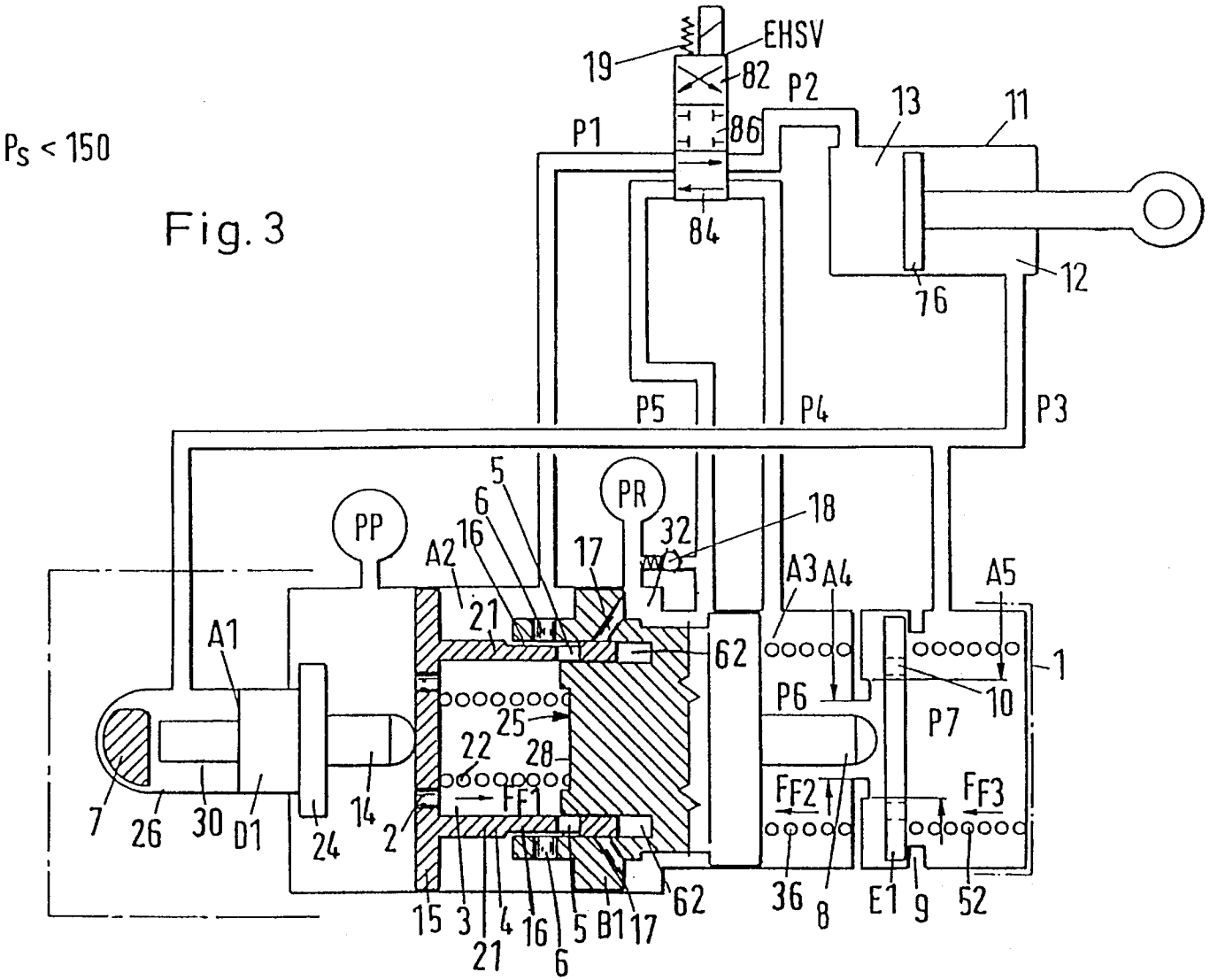
FIG. 3 is another semi-schematic side view of the multi-functional valve of FIG. 2 wherein the EHSV is in an extension mode.

FIGS. 2 and 3 illustrate the operation of the multi-functional valve 1 at a pressure below approximately 150 bar. FIG. 2 shows operation in the retraction mode and FIG. 3 depicts operation in the extension mode.

When the supply pressure is below about 150 bar, the force exerted by the differential piston B1 is not great enough to force the tappet to contact the disc seat valve E1 and to thus overcome the force of the springs 36, 52; the disc seat valve E1 is therefore held in its closed position. This separates the right pressure chamber P6 from the overflow chamber P7. Because the right pressure chamber P6 and the overflow chamber P7 are separated, i.e. the borings 10 are closed or blocked, no hydraulic fluid can flow into the overflow chamber P7 and through the third conduit P3 to the retraction chamber 12. As a consequence, the piston 76 cannot be forced to extend further into the cylinder 11.

If the EHSV is placed in the extension mode shown in FIG. 3, the supply pressure port is able to exert a retraction force or pressure on the piston 76 through the first and second conduits P1 and P2 respectively via the EHSV. This causes an increase in the pressure through the third conduit P3 and, thus, also in the overflow chamber and on the pressure limitation piston D1 in the pressure effective area A1. The pressure on the pressure limitation piston D1 causes the tappet 14 to move to the right, as depicted in FIG. 3, and to exert a force on the differential piston B1. This force is of a magnitude sufficient to overcome the force of the springs 36, 52 and to move the disc seat valve E1 into its open position. Thus, the right pressure chamber P6 and the overflow chamber P7 are once again connected through the borings 10 and the feedback port PR is once again connected to the retraction chamber 12. At this time, then, flow through the right pressure chamber P6 and the overflow chamber P7 can continue. The piston 76 within the differential chamber 11 can now be controlled to extend or retract by the multi-function valve 1.

Figure 4:
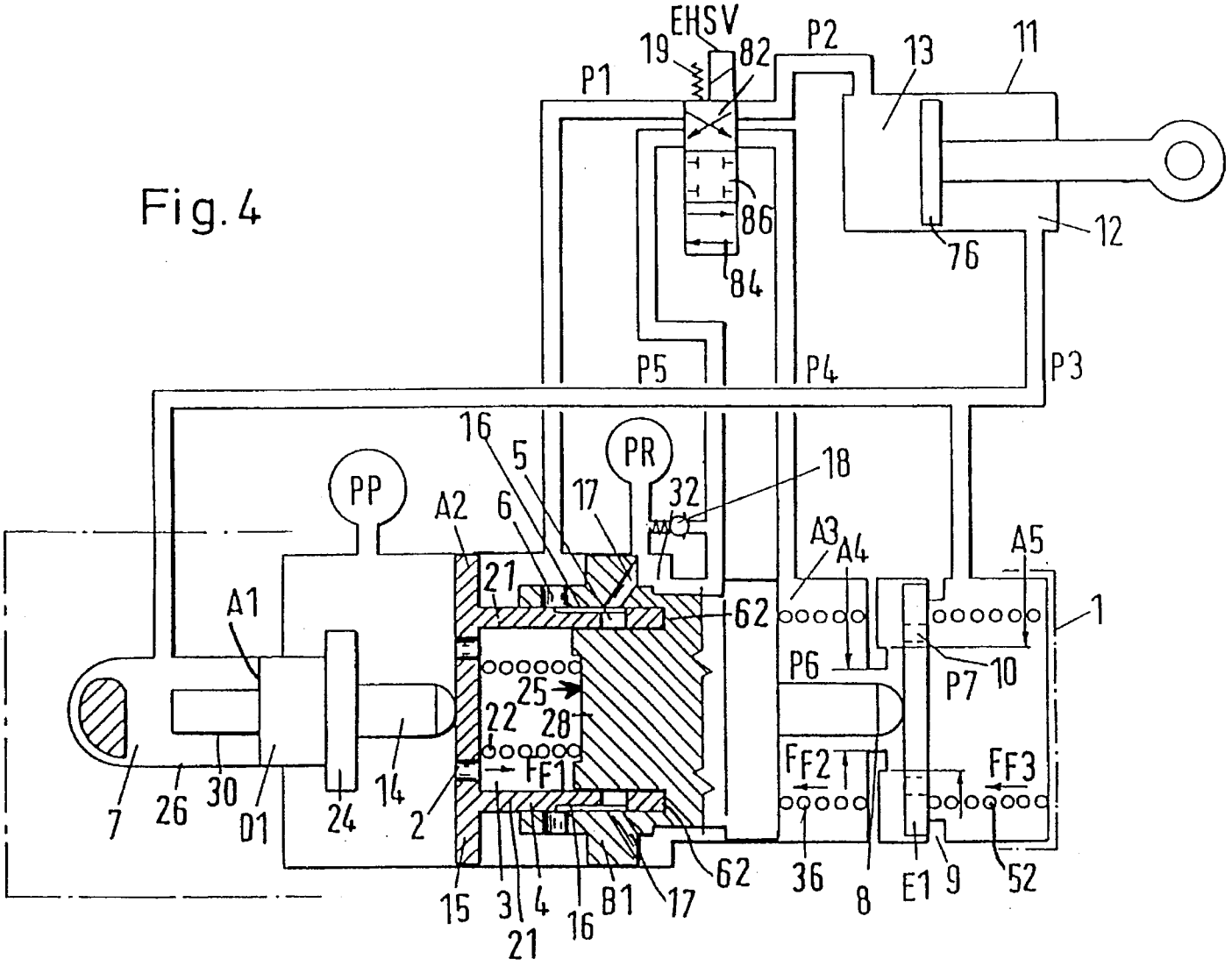
FIG. 4 is still another semi-schematic side view of the multi-functional valve of FIG. 1 operating in a mode providing thermal relief.

FIG. 4 illustrates operation of the valve 1 in the thermal relief mode, which is in effect when the supply pressure and feedback pressure are at 0 bar. If the multifunctional valve is used in an aircraft, this mode would only take effect when the aircraft is on the ground. In thermal relief mode, pressure in the control conduits increases due to solar radiation impacting the wings of the aircraft and the associated heating of the differential cylinder 11, the third conduit P3 the overflow chamber P7.

At a pressure of, for example, 260 bar in the third conduit P3 as a result of these effects, pressure increases behind the pressure limitation piston D1, causing the piston D1 to move towards the tappet 14. The pressure limitation piston D1 forces the tappet 14 to the right, as depicted in FIG. 4, and thus towards the control element 15. The pressure acts with assistance from the difference in area between the pressure effective area A1 and the pressure effective area A4 to overcome the force of the springs 36, 52; the difference in these areas acts to effectively increase the pressure since A1 is larger than A4.

The pressure on the control element forces the bushing leg 21 into the recess 62 of the differential piston B1. When the bushing leg 21 extends to the depth of the recess 62, the differential piston B1 is forced towards the tappet 8 and disc seat valve E1. This force is sufficiently large to overcome the force of the springs 36, 52 and to move the disc seat valve E1 into its open position. The movement of the disc seat valve E1 into the open position re-establishes the connection between the right pressure chamber P6 and the overflow chamber P7.

The movement of the bushing 4 and differential piston B1 act to block the supply pressure port PP; thus, no connection between the supply pressure port PP and the first conduit P1 will exist. This positioning of the bushing leg 21 is effective to connect the feedback port PR with both the extension chamber and the retraction chamber. The connection with the extension chamber is through the fifth conduit P5 and the second conduit P2 via the EHSV. The connection with the retraction chamber 12 is through the slanted boring 17, the overflow channel 66, the pressure effective area A2, the first conduit P1 via EHSV to the fourth conduit P4, the right pressure chamber P6, the overflow chamber P7 and the third conduit P3. The multi-function valve 1 is thus able to control the hydraulic system when the supply and feedback pressures are zero to place the system in an equilibrium condition.

Figure 5:
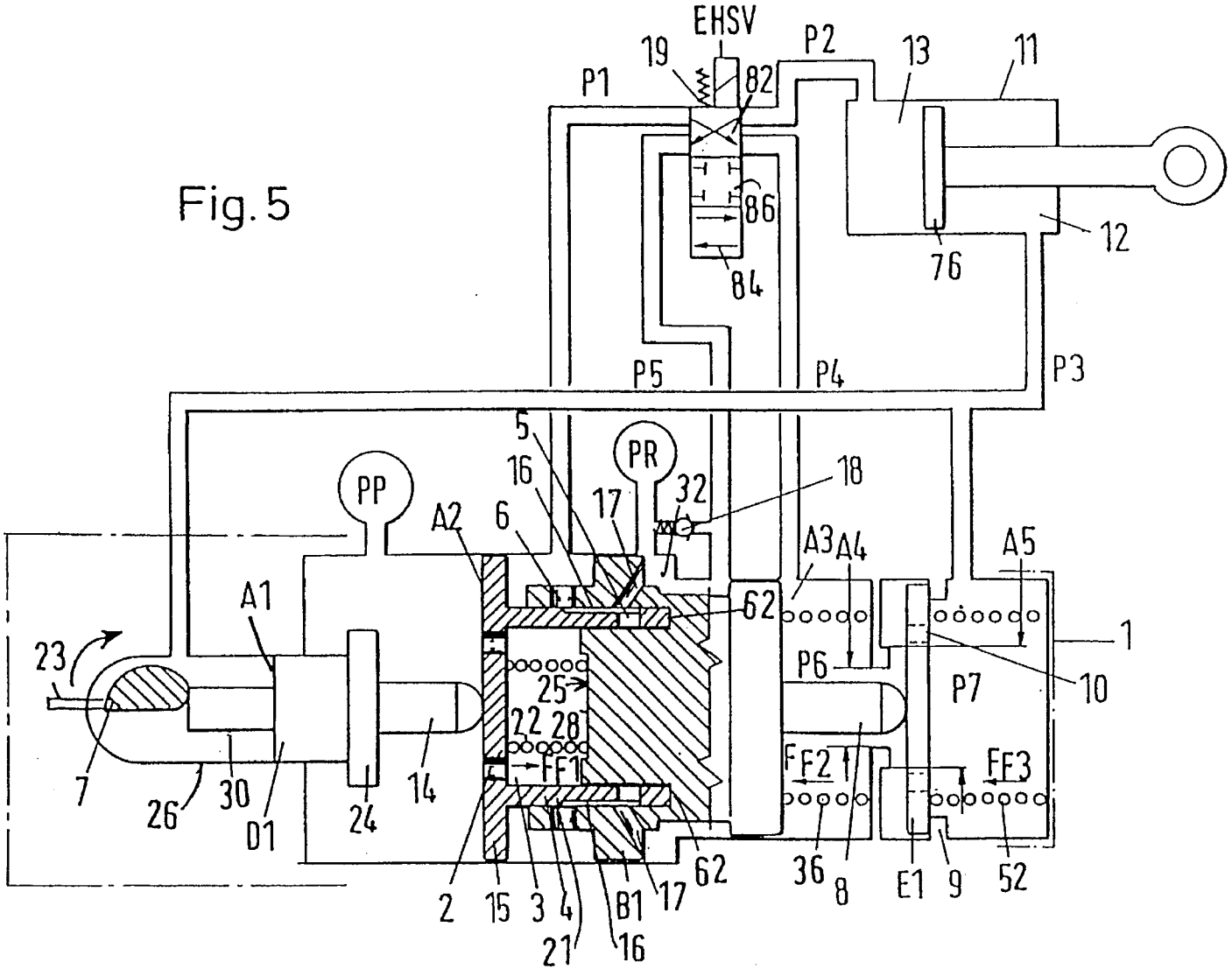
FIG. 5 is a further semi-schematic side view of the multi-functional valve of FIG. 1 operating in a maintenance mode.

FIG. 5 illustrates operation of the multi-function valve 1 in the maintenance mode, which provides for free movement upward and downward of an aircraft spoiler, for example, at a low force such as 250N. In this mode the cam 7 is manually rotated, as indicated by the arrow in FIG. 5, by an external lever 23. The external lever 23 may alternately be located or project from cam 7 in a manner other than that shown by way of example in FIG. 5, such as projecting from the cylinder housing along or in a direction parallel to the axis of rotation of the cam 7. When manually or otherwise selectively rotated by the external lever 23 to the FIG. 5 position, the cam 7 acts with the piston rod 26 to engage and exert a rightward (in FIG. 5) force on the pressure limitation piston D1, displacing the piston D1 towards the tappet 14 which, in turn, exerts a force on the control element 15. The control element 15 displaces the bushing leg 21 into the recess 62 of the differential piston B1. Once the bushing leg 21 reaches the limit of the recess 62, it forces the differential piston B1 to move the tappet 8 and thus open the disc seat valve E1, which is held in position against the rearwardly inward protrusion 9.

The movement of the bushing 4 and differential piston B1 act to block the supply pressure piston PP, and thus no connection with the first conduit P1 exists. This prevents the system from operation through control of the EHSV and thus eliminates the possibility of injury through unintentional actuation of the valves when performing maintenance work. This state or condition of the multi-function valve accordingly acts to prevent the differential cylinder from operation.

Figure 6:
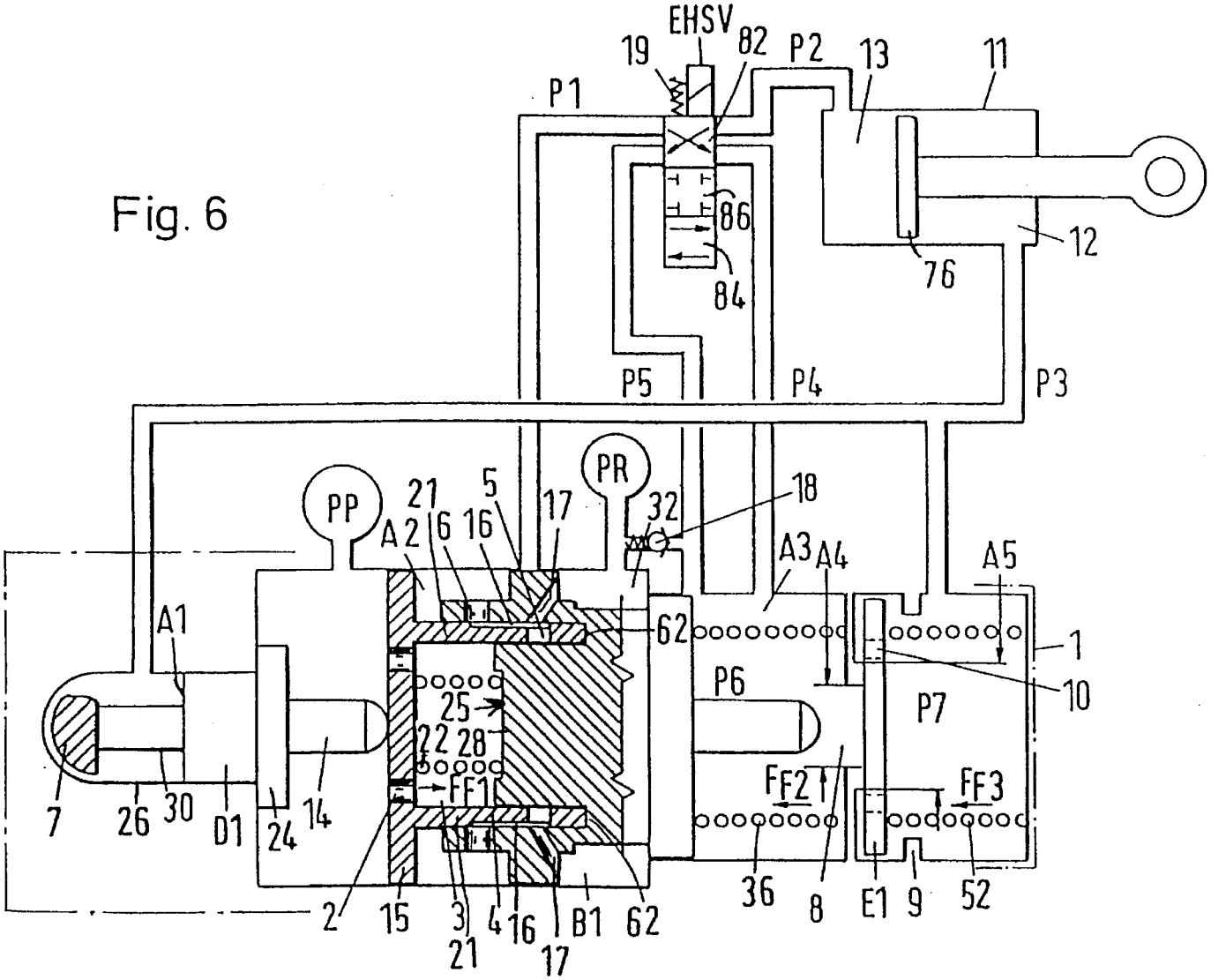
FIG. 6 is yet another schematic side view of the multi-functional valve of FIG. 1 operating in a mode after an hydraulic supply malfunction or an electrical control system error.

FIG. 6 depicts the multi-function valve after either a supply malfunction or an electrical control signal error. In such a situation, the EHSV will switch into a bias or rest position 86. The EHSV enters this position through the reset device 19 upon establishment of an equilibrium condition in the differential cylinder 11. The reset device may be a spring or any other suitable structure or form for resetting the EHSV.

In this situation, there is no pressure in the supply conduit PP and, thus, the piston B1 is acted upon by the spring 36 and displaced to the left as shown in FIG. 6. The spring 36 moves the piston B1 to the left such that the bushing leg 21 meets a bottom of the recess 62 and the control element 15 is contacted by the tappet 14. At this point, the piston B1 is in a position blocking access to the first conduit P1 from the supply pressure port PP, the chamber 3 and the pressure effective area A2.

The EHSV is in its retraction position, causing the plunger 76 to retract and to also connect the fifth conduit P5 to the extension chamber 13. As the plunger retracts, the disc seat valve E1 is opened. This connection is established through the second conduit P2 via the EHSV. As the fifth conduit P5 and the fourth conduit P4 are connected by a bypass conduit (not shown), the fifth conduit P5 is also connected to the third conduit P3 through the right pressure chamber P6, the borings 10 and the overflow chamber P7. Thus, the fifth conduit P5 is also connected to the retention chamber 12.

The feedback port PR is connected to the fifth conduit P5 through the check valve 18 via which the excess fluid can flow off. The check valve 18 is preferably preloaded to a pressure of about 8 bar. The extension chamber 13 and the retraction chamber 12 are now connected together through the series of conduits and chambers mentioned above. The piston 76 in the differential cylinder 11 retracts causing the disc seat valve E1 to be in its open position. Once an equilibrium pressure is restored, the disc seat valve E1 is closed and maintained in its closed position by the force from the spring 52. As the disc seat valve E1 is now in its closed position, the differential cylinder 12 is isolated from the remainder of the system. The piston 76 is thus prevented from extending further into the cylinder 11 under the force of external loads such as wind. Furthermore, the feedback port PR and supply pressure port PP may include check valves (not shown) which prevent air from entering the hydraulic system and disturbing the equilibrium condition.

When an electrical malfunction occurs, such as an interruption of the electrical signal, the EHSV switches into the bias or reset state and is restored to its original or prior operating mode upon restoration of the electrical signal. If an error message is received, such is registered by the flight control computer of the aircraft to which the hydraulic system is connected and current is removed from the EHSV. When the current is cut off, the EHSV is triggered into its rest or bias position through the resetting device 19 and behaves as if the piston 3 has been retracted in the differential cylinder 11 and held in its retracted position, for example as if there has been a total hydraulic loss. Thus it can be seen that, when the hydraulic supply malfunctions or an electrical control signal error is received, the valve is able to reset or establish an equilibrium condition in the system. The system then continues normal operation once the electric control signal is restored or hydraulic operation is restored.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. In an hydraulic system including a high-pressure differential cylinder having a piston dividing said cylinder into a retraction chamber and an extension chamber, an electro-hydraulic servo valve including means for resetting said valve, a first connecting conduit for connecting said differential cylinder and said electro-hydraulic servo valve, a plurality of second conduits, a valve housing, and a multi-functional valve positioned within said valve housing and hydraulically connected to said differential cylinder via said plurality of second conduits and said servo valve, said multi-functional valve comprising a plurality of correcting elements positioned in said housing along a functional axis of said multi-functional valve, said plurality of correcting elements including a differential piston centrally disposed within said valve housing and movable along the functional axis of said multi-functional valve free of transverse forces, a first spring, a disc seat valve movable against a force of said first spring between an open and a closed position, a tappet positioned between the differential piston and the disc seat valve, a stop, a second spring coupled to said differential piston; and a damping and control element positioned between said differential piston, and said stop so that, in an unpressurized mode, said second spring exerts an adjusting force on said differential piston to hold said differential piston and said damping and control element in a rest position against said stop and, in a pressurized mode, said differential piston overcomes said adjusting force of said second spring and a force applied by said first spring on said disc seat valve to move said disc seat valve into said open position via said first tappet.

2. In an hydraulic system in accordance with claim 1, said plurality of correcting elements comprising a first, a second and a third interacting valve for controlling extension and retraction of said piston.

3. In an hydraulic system in accordance with claim 1, said stop including a pressure limitation piston projecting into said housing and arranged for movement along said functional axis to engage said damping and control element.

4. In an hydraulic system in accordance with claim 3, further comprising a feedback port; a first piston region located on a first side of said differential piston; a second piston region located on a second side of said differential piston; and an intermediate area defined between said first and second piston regions, said differential piston being disposed adjacent said intermediate area and in constant communication with said feedback port through said intermediate area.

5. In an hydraulic system in accordance with claim 4, further comprising a pressure supply for supplying pressure to said system, said control element having a cylindrically shaped side wall having at least one boring extending therethrough and a cover piece positioned on a first side of said side wall having at least one boring extending therethrough, said differential piston including a circular slot having at least one boring therein and for accommodating said cylindrically shaped side wall in said slot, a circular recess in a face side of said differential piston, and a slanted boring extending through the differential piston between said slot and a side wall of said differential piston adjacent said feedback port; and a third spring positioned within the circular recess and exerting a force on said cover piece, so that, when said cylindrical side wall extends to fill said circular slot, said slanted boring in said recess and said at least one boring in each of said side walls communicate to connect said feedback port and a first of said plurality of second conduits and, when said cylindrical side walls are in a position fully extended from said slot, said at least one boring in each of said recess, side walls and cover communicate to connect said supply pressure port and said first of said plurality of second conduits, and so that a rim of said cylindrical side wall functions as a control edge for establishing a connection between one of said feedback port, and said supply pressure port and said first of said plurality of second conduits.

6. In an hydraulic system in accordance with claim 5, further comprising a cylinder housing including said pressure limitation piston therein and being connected between said valve housing and said retraction chamber of said differential cylinder, said connection to said retraction chamber being via a second of said plurality of conduits; a second tappet; and a ring band positioned between said pressure limitation piston and said second tappet, said ring band being positioned against a side wall of said valve housing when said pressure limitation piston is in a fully retracted mode.

7. In an hydraulic system in accordance with claim 6, further comprising a piston rod connected on a first side thereof to said pressure limitation piston; and a cam coupled to a second side of said piston rod for engaging said pressure limitation piston through said piston rod, said cam being positioned within said cylinder housing.

8. In an hydraulic system in accordance with claim 1, further comprising a right pressure chamber and an overflow chamber having a seat projecting therein, said right pressure chamber and said overflow chamber being separated by said disc seat valve, said first tappet being extendable between said right pressure chamber and said overflow chamber for exerting a force from said differential piston on said disc seat valve to move between said open position against said seat and said closed position separating said right pressure chamber and said overflow chamber, said overflow chamber being connected to said retraction chamber by a second of said plurality of conduits.

* * * * *